US006412148B1

(12) United States Patent
Morris

(10) Patent No.: US 6,412,148 B1
(45) Date of Patent: Jul. 2, 2002

(54) DEVICE FOR FASTENING A STRAP

(75) Inventor: John L. Morris, Durham, CT (US)

(73) Assignee: Buckles International, Inc.

( * ) Notice: Subject to any disclaimer, the term of this patent is extended or adjusted under 35 U.S.C. 154(b) by 0 days.

(21) Appl. No.: 09/602,748

(22) Filed: Jun. 23, 2000

(51) Int. Cl.[7] ..... A44B 11/22
(52) U.S. Cl. ..... 24/176; 24/177
(58) Field of Search ..... 24/312, 323, 176, 24/324, 177, 578.15, 182, 186, 163 R, 379.1, 307, 322.1, 199, 697.2, 318; 2/322

(56) References Cited

U.S. PATENT DOCUMENTS 1,034,681 A * 8/1912 Bliss
1,445,075 A * 2/1923 Erpenbeck
1,682,450 A * 8/1928 Wanninger et al.
1,785,947 A * 12/1930 Fowler
2,049,414 A * 8/1936 Cohen
2,783,516 A * 3/1957 Stein
3,913,147 A * 10/1975 Ostrander
4,179,755 A * 12/1979 Clark

* cited by examiner

*Primary Examiner*—James R. Brittain
(74) *Attorney, Agent, or Firm*—R. William Reinsmith; Murtha Cullina LLP

(57) ABSTRACT

A device is disclosed featuring a buckle removably attached to a size adjustment end portion of a strap having a series of size adjustment holes in the strap. A strap receiving retainer and a hook-like tongue are integrally formed in fixed relation to opposite sides of a frame of the buckle with the tongue extending through a selected hole in the underlying size adjustment strap end portion and through an aperture in a plate attached to an opposite end portion of the strap.

12 Claims, 6 Drawing Sheets

DEVICE FOR FASTENING A STRAP

FIELD OF THE INVENTION

The present invention generally relates to a device for fastening a strap around an object, and more particularly to a device for fastening a belt around the waist of a person.

BACKGROUND OF THE INVENTION

A buckle is a fastener that attaches two strap ends together. Usually a buckle fastens together both ends of a strap designed to wrap around an object or objects. Straps that wrap around the waist are belts. Belt buckles, a class of buckles, fasten one end of a belt to its other end to form a loop that secures the belt around the waist of a person. The belt end opposite its buckle end is usually adjustably engageable with the buckle to form loops of various sizes.

Sam Browne belts, well known belts used by uniformed law enforcement officers, employ so-called center bar buckles with a rectangular frame, a center bar and two tongues each having one end fixed to the bar and extending substantially perpendicular to the bar. The bar pivots on the frame which supports the center bar for rotation about its axis such that the center bar and two tongues move in unison.

The Sam Browne belt includes a fastening member in the form of a bar permanently secured to one end of the belt strap with two hook-shaped prongs integrally formed at substantially right angles to each end of the bar. An opposite size adjustment end portion of a Sam Browne belt strap includes a top row and a bottom row of holes. Each hole on either row is aligned with a hole on the other row such that each pair of holes falls on a line substantially vertical to the length of the strap.

Unlike many other conventional belt buckles that are permanently attached to the belt, Sam Browne buckles are not permanently secured to the strap. Rather, Sam Browne buckles are removably assembled to the size adjustment end portion of the strap and may be adjusted in position along the strap to change the belt size. The buckle is adjusted in position by first threading the belt strap under one side of the frame and over the bar while maneuvering the prongs to go through a given pair of aligned holes in the strap, and finally passing the strap under the frame at its opposite side. Once mounted on the strap, the center bar of the buckle is positioned behind the concealed surface of the strap for engagement with the prongs of the fastening bar fixed to the other strap end to secure the belt in place.

Although the position of the Sam Browne buckle may be changed along the length of the strap, actual buckle adjustment is cumbersome because the straps of Sam Browne belts are made of thick belting leather that do not yield well, thus making such adjustments quite difficult. Because threading the belt strap through the buckle over its center bar is difficult, adjustability of the buckle on Sam Browne belts presents practical difficulties to users.

Once fastened, a loose end of the strap extends beyond the buckle and remains free. Having a loose end is undesirable. By pulling the loose end away from a person wearing the belt, the center bar readily disengages from the hooks of the underlying fastening bar. To secure a loose strap end, a button is usually incorporated in a Sam Browne belt with the button permanently mounted on the underlying strap behind its fastening bar to extend through a selected perforation in a row of holes provided on the size adjustment end portion between the top and bottom rows of tongue holes to capture the end of the belt strap.

Even with the addition of the button, conventional Sam Browne belts remain susceptible to accidental or forced release. Sam Browne belts normally support a variety of equipment including handguns. During a physical struggle, a conventional Sam Browne belt can be pulled loose, possibly with loss of access to a handgun.

Another longstanding and significant problem common to a conventional Sam Browne belt is that the manufacture and assembly of the fastening bar and the button onto the strap requires several steps which, if not carried out skillfully and precisely, may result in discarding the strap. These steps may include, but are not limited to: die cutting the strap, skiving the leather at an end of the strap opposite its size adjustment end, that is, shaving the leather to reduce its thickness so that it can be folded over the fastening bar. Then the strap must be sewed and/or glued to secure the fastening bar. This process is not only labor intensive, but care must be taken to ensure that the fastening bar and the button are precisely spaced apart to match the buckle center bar and the middle row holes in different buckle positions. Because of the multitude of steps and their requirements for precision, error is not uncommon in the manufacture and assembly of Sam Browne belts that result in undesired quantities of straps being scrapped during manufacturing.

OBJECTS OF THE INVENTION

An object of this invention is to provide an improved device having readily adjustable parts for fastening a strap around an object such that the strap can be fastened around objects of varying sizes with relative ease.

A further object of this invention is to provide such a device for use with making belts and providing improved resistance to unintended release or disengagement and easier size adjustability.

Yet another object of this invention is to provide an improved buckle device particularly suited for use with Sam Browne belts and which are relatively easy and economical to manufacture and assemble.

A yet further object of this invention is to provide a buckle device of the type described that does not require altering standard Sam Browne belt straps and thus avoids increase in manufacturing costs of such belt straps, such as re-tooling for custom manufacturing, while maintaining a desired garrison stylizing associated with conventional Sam Browne belts during use.

Other objects will be in part obvious and in part pointed out more in detail hereinafter.

SUMMARY OF THE INVENTION

A belt incorporating this invention includes a movably adjustable buckle with fixed tongue means, a strap typically used in the making of Sam Browne belts and a fastening platform mounted on the strap to engage the fixed tongue means of the buckle.

The buckle of this invention comprises a frame and a pair of hook-shaped tongues fixed to a side of the frame. The tongues are C-shaped and extend inside the frame to pass through top and bottom perforations on a conventional Sam Browne belt strap, and a retainer is integrally formed on the back of the frame to allow the buckle to be guided and temporarily positioned on the strap during adjustment and to resist unintended release.

A fastening platform of this invention is mounted on a conventional Sam Browne belt strap end to engage a buckle on an opposite size adjustment end of the strap for fastening the strap. A preferred embodiment of the platform includes a back plate having two apertures to engage a pair of fixed tongues of a buckle, and a third aperture for optional placement of a button.

A better understanding of the objects, advantages, features, properties and relations of the invention will be obtained from the following detailed description and accompanying drawings which set forth certain illustrative embodiments and are indicative of the various ways in which the principles of the invention are employed.

DETAILED DESCRIPTION OF A PREFERRED EMBODIMENT OF THE INVENTION

Figure 1:
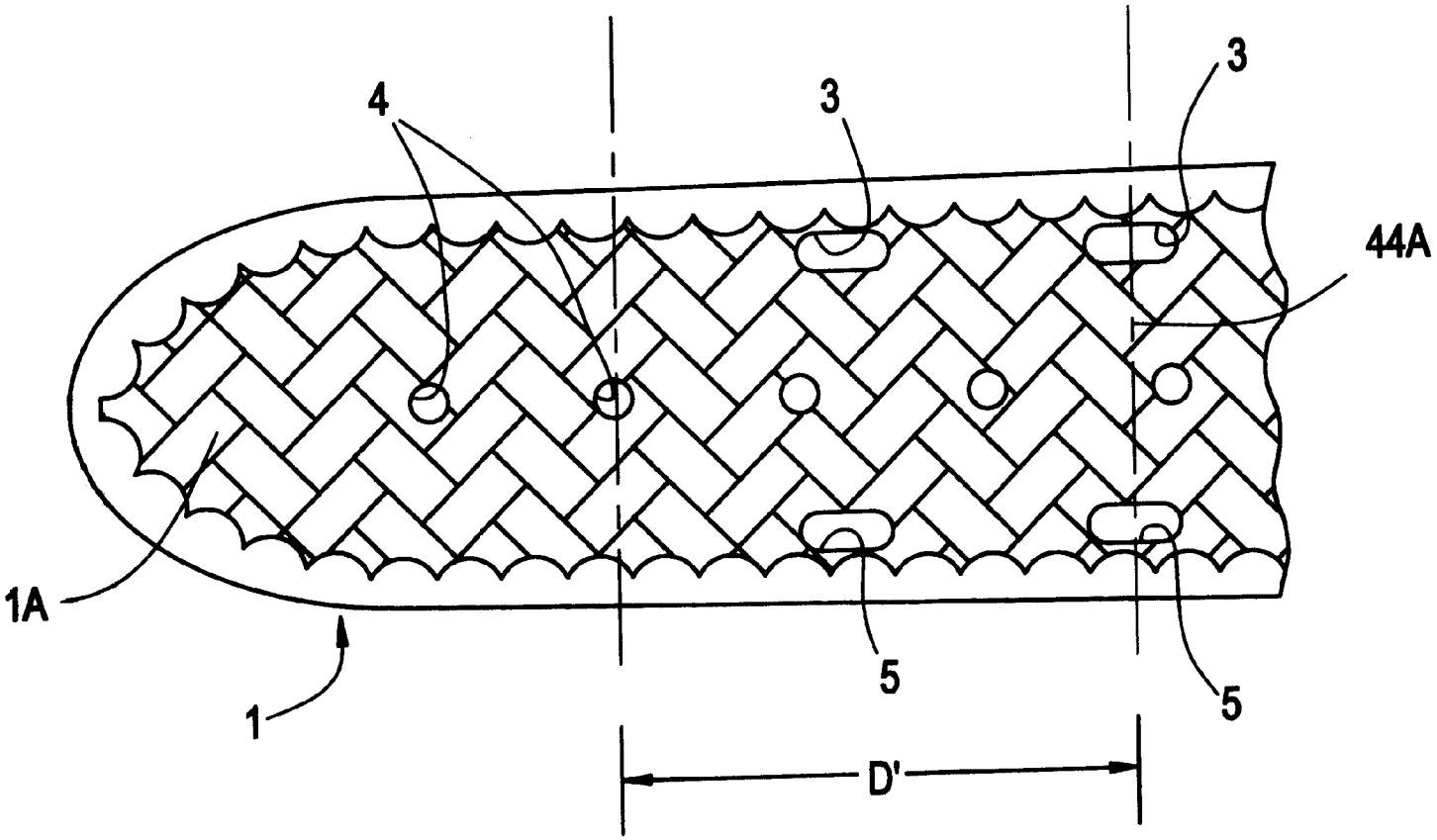
FIG. 1 PRIOR ART
FIG. 1 is a front view, partly broken away, showing a size adjustment end portion of a conventional Sam Browne belt strap.

Referring now to the drawings, FIG. 1 shows a conventional Sam Browne belt strap 1. Three rows of holes are formed such as by die cutting on a size adjustment end portion 1A of strap 1, a top row of holes such as at 3, a middle row of holes such as at 4 and a bottom row of holes such as at 5. Adjacent holes 3 on the top row and adjacent holes 5 on the bottom row are spaced apart the same distance from one another in each row, and pairs of holes 3,5 are each in vertically aligned relation to one another along the length of belt 1. Adjacent holes 4 in the middle row are equally spaced from one another and equidistant but not in alignment with those on the top and bottom rows.

Figure 2:
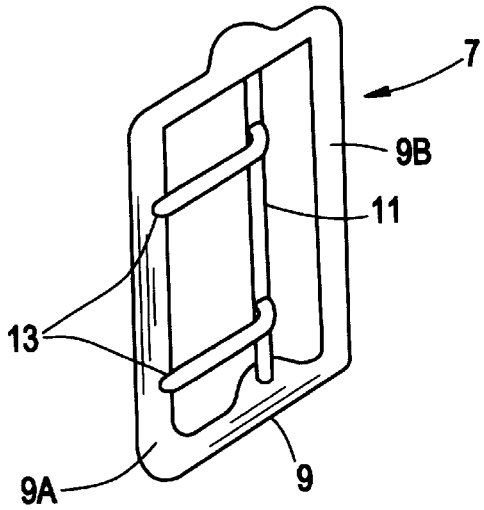
FIG. 2 PRIOR ART
FIG. 2 is a perspective view of a conventional Sam Browne belt buckle with pivoting center bar tongues.

FIG. 2 shows a conventional Sam Browne buckle 7, which includes a frame 9, a center bar 11 supported for pivoting movement in the middle of the frame 9, and a pair of tongues 13 attached to center bar 11. Bar 11 is mounted on frame 9 such that it is free to rotate about its axis, thus allowing tongues 13 to swing from one side 9A of frame 9 to the other side 9B.

Allowing tongues 13 the freedom to pivot accommodates strap 1 as it is passed under side 9A of frame 9, over bar 11, and again under the opposite side 9B of frame 9 during placement of buckle 7 onto strap 1. The tongues 13 will pass through a pair of top and bottom holes 3,5 of strap 1 to secure buckle 7 on strap 1 which is aided by the movable tongues 13 during manipulation of the heavy leather belt strap 1 so that buckle 7 may be selectively removed and placed at a different location along strap 1 when size adjustment of the belt becomes necessary.

Figure 2A:
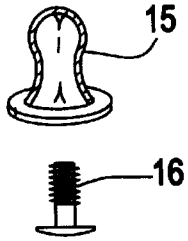
FIG. 2A PRIOR ART
FIG. 2A is a perspective view of a conventional Sam Browne belt button and back member in disassembled relation.
Figure 4:
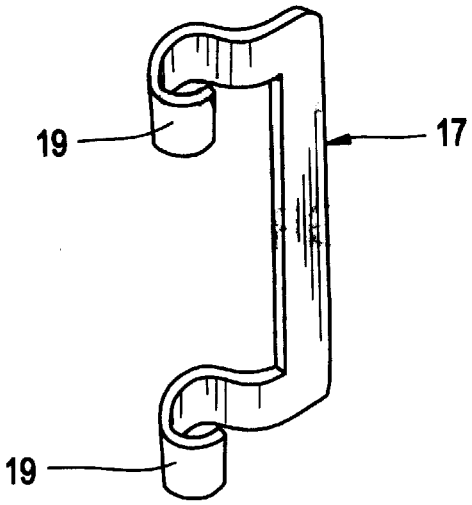
FIG. 4 PRIOR ART
FIG. 4 is a perspective view of a fastening member providing hooks as used in the Sam Browne belt of the type shown in FIG. 3.
Figure 3:
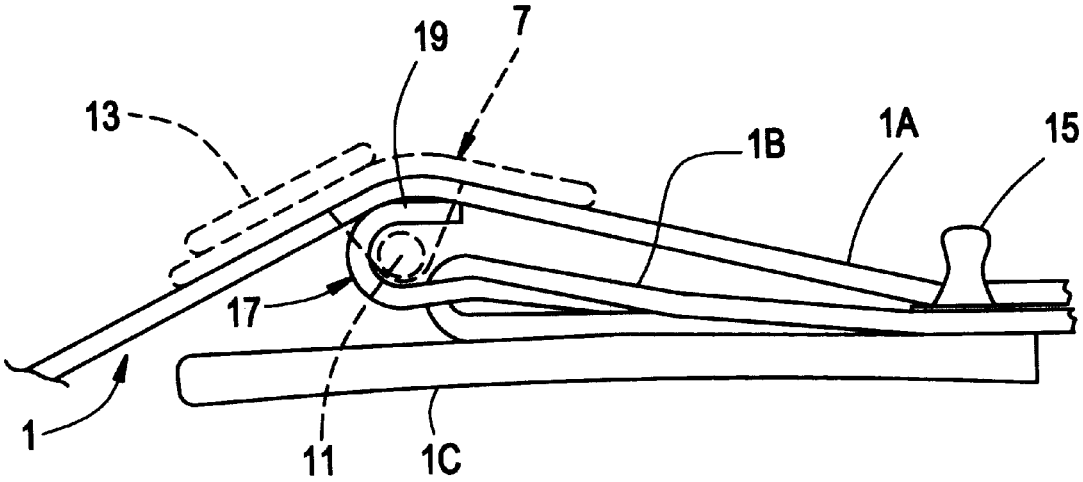
FIG. 3 PRIOR ART
FIG. 3 is a plan view showing one end of a Sam Browne belt of conventional hook and button design.

FIG. 3 shows various conventional individual parts, namely, a button 15 (best seen in FIG. 2A) and a fastening member 17 (best seen in FIG. 4) which are separately assembled on an end portion 1B of a conventional Sam Browne belt strap 1 opposite its size adjustment end portion 1A. End portion 1B is shown having an optional back flap 1C which will be understood to be in contact with a waist of one wearing the belt. Fastening member 17 has hooks 19 engageable with buckle bar 11 to secure the opposite belt ends. As will be appreciated, assembly of fastening member 17 onto the strap requires preparing the strap to accept the fastening member 17 including die cutting and then skiving to reduce the belting leather thickness so it can be folded over fastening member 17. The assembly further requires precise positioning of both the fastening member 17 (FIG. 4) and also the button 15 and its back member 16 (FIG. 2A) on strap end portion. 1B prior to stitching, gluing or other means to secure the fastening member 17 in place such that its hooks 19,19 and button 15 are precisely positioned to respectively grip buckle bar 11 and pass through a hole 4 on the middle row of a Sam Browne belt strap 1. As the assembly of these parts is often done by hand, the manufacturing of conventional Sam Browne belts is susceptible to human error that can result in a number of such belts being discarded during the course of manufacturing.

Figure 5:
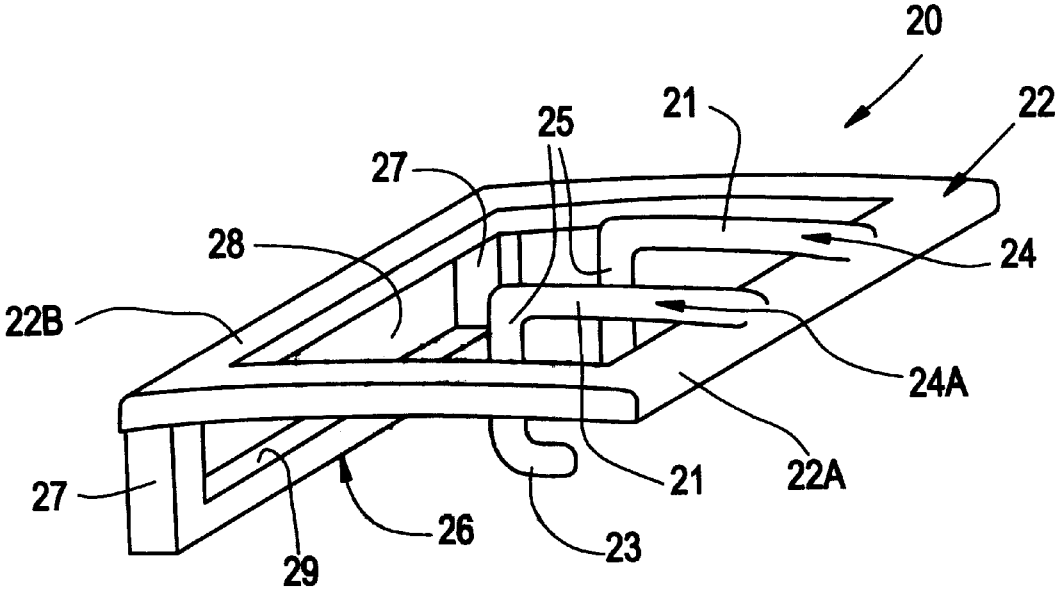
FIG. 5 is a perspective view of an adjustable buckle constructed according to this invention.
Figure 6:
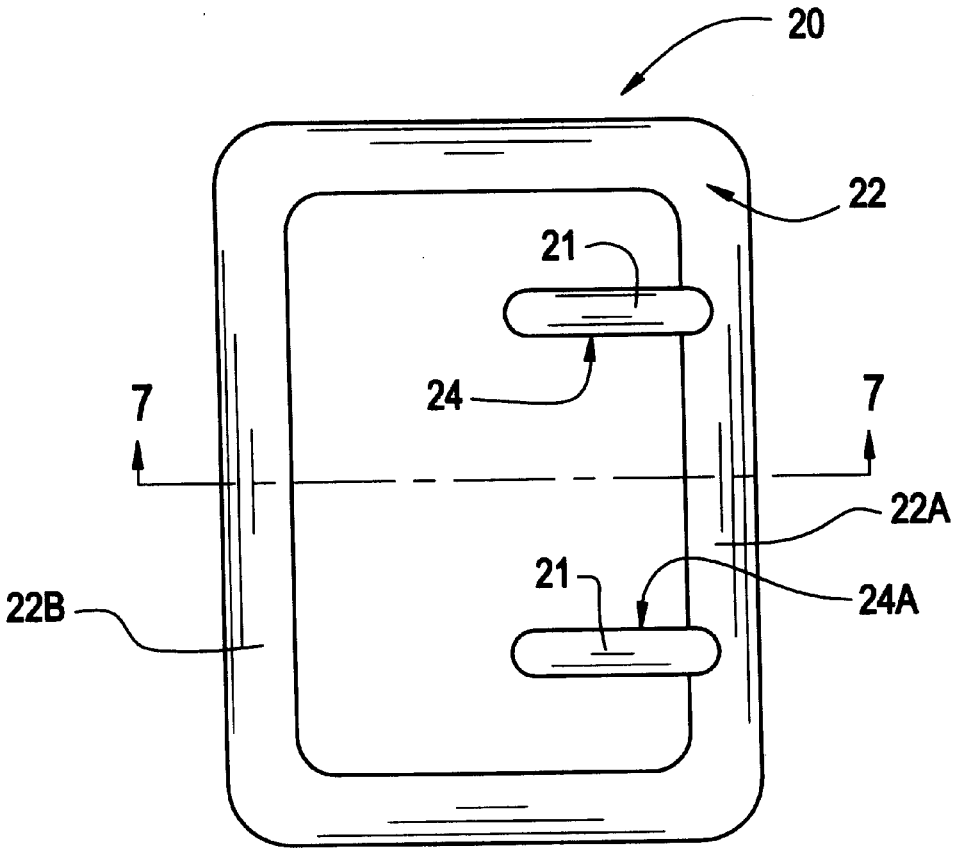
FIG. 6 is a plan view of the buckle of FIG. 5.
Figure 7:
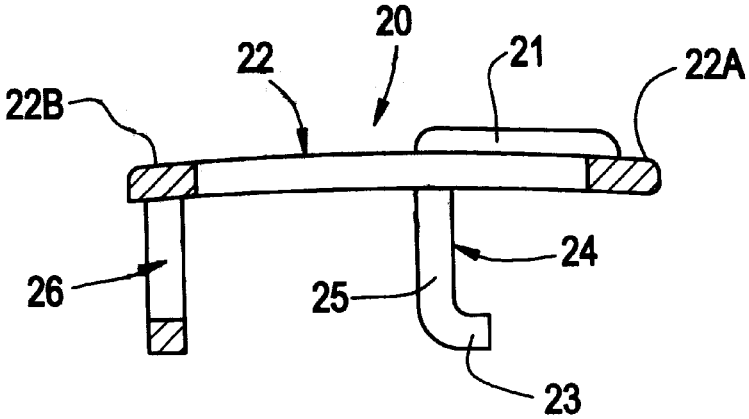
FIG. 7 is a sectional view of the buckle of FIG. 6 taken along line 7—7.

To minimize costs and problems associated with the manufacture and assembly of Sam Browne belts while maintaining the spacings and arrangements of the holes in the size adjustment end of the conventional belt strap 1 so as to be compatible for use with such conventional belts, a preferred embodiment of this invention features a uniquely designed buckle for the size adjustment end portion 1A of strap 1 which coacts with a fastening platform on the opposite strap end portion 1B. The buckle 20 of this invention, as best seen in FIGS. 5–7, includes a generally rectangular open frame 22, a pair of hook-shaped tongues 24,24A and a retainer 26 forming a slot 28 on the back of buckle 20.

More specifically, top tongue 24 and bottom tongue 24A are integrally mounted on side 22A of the frame 22 and are configured as C-shaped hooks to extend inwardly and downwardly from side 22A. Tongues 24,24A are spaced apart to register with and pass through a pair of aligned top and bottom holes 3,5 of a conventional Sam Browne belt strap 1. Each tongue has a first leg 21 extending toward side 22B of the frame, a second leg 23 extending in a direction opposite frame side 22B and an intermediate portion 25 interconnecting legs 21 and 23.

Retainer 26 is integrally formed on the concealed back of side 22B of buckle 20 opposite side 22A. Retainer 26 includes a pair of spaced opposed arms 27,27 and a bar 29 interconnecting the arms with bar 29 in spaced parallel relation to frame side 22B and forming a generally rectangular slot 28. Retainer 26 accordingly serves to guide the buckle 20 onto the strap and to temporarily position the buckle as its tongues are manipulated to pass through the size adjustment holes to position buckle 20 on strap 1 in a quick and easy fashion.

Figure 8:
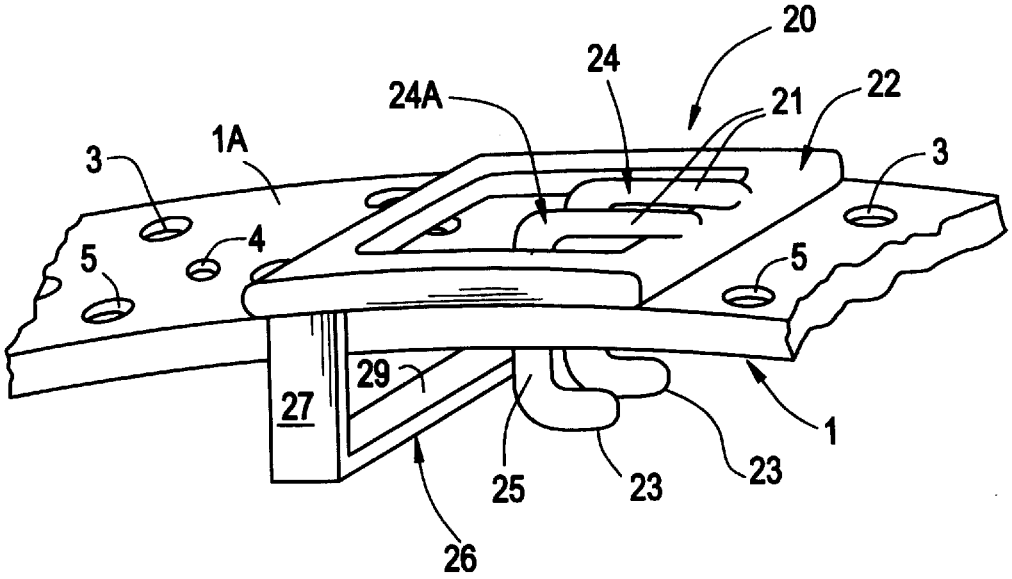
FIG. 8 is a plan view, partly broken away, showing the buckle of FIG. 5 mounted on a size adjustment end portion of a conventional Sam Browne belt strap.

FIG. 8 shows buckle 20 installed on a size adjustment end portion 1A of a conventional Sam Browne belt strap 1. Once positioned, buckle 20 is easily adjustable along the length of the strap, and there is no requirement that the thick leather belting strap be disengaged from the tongues of a center bar and again threaded in and out of a buckle over any center bar, as is the case with conventional Sam Browne buckles. All one has to do to adjust the buckle of this invention, is to pull the tongues 24,24A out of a pair of holes 3,5, move buckle 20 to a desired position along strap end portion 1A, and pass the tongues 24,24A through a newly selected pair of size adjustment holes 3,5.

Figure 9:
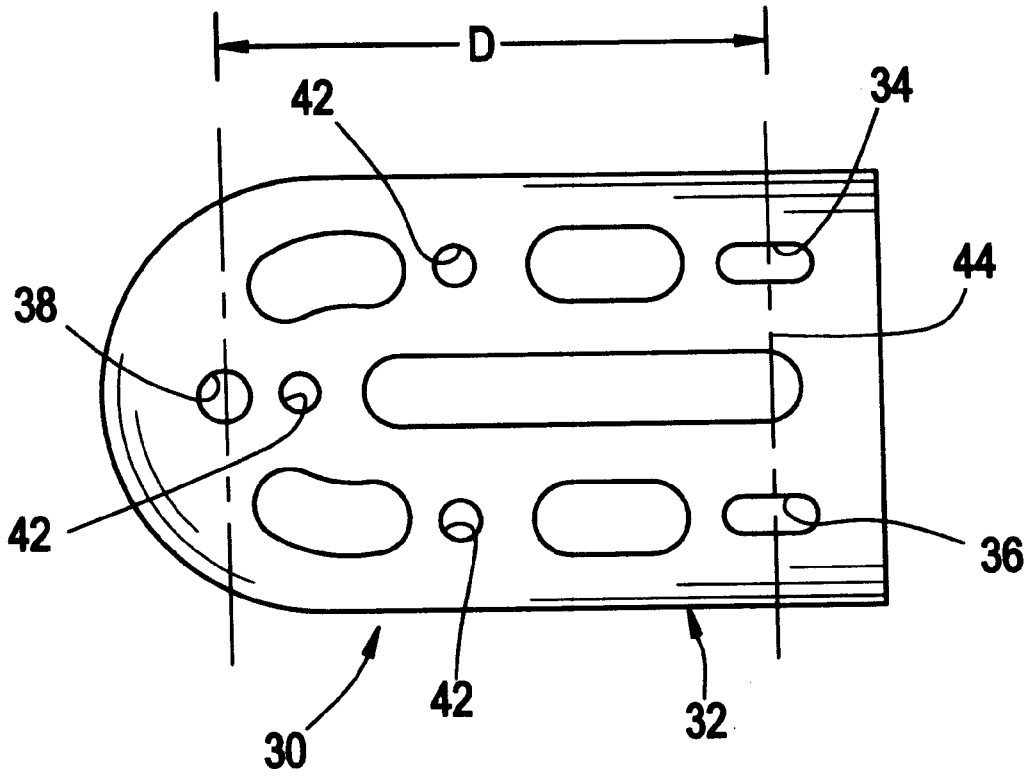
FIG. 9 is a front view of a preferred embodiment of a fastening platform constructed according to this invention.

To eliminate any need for the problem laden conventional hook and button design in securing the belt, a fastening platform 30 (FIGS. 9,10) is provided to engage buckle 20 in accordance with this invention. Platform 30 comprises a back plate 32 with upper and lower tongue-receiving apertures 34 and 36. These apertures are formed near the corners of one end of plate 32 to receive tongues 24 and 24A of the buckle 20, and a third aperture 38 is centrally formed at an opposite end of plate 32 for optional mounting of a button 40 (FIG. 10) pre-assembled on plate 32 for securing the free end of the belt upon being fitted through a selected hole 4 in the middle row of perforations in belt end portion 1A. Back plate 32 shown in FIG. 9 also includes mounting holes such as at 42 to allow mounting the back plate 32 such as by rivets, not shown, to a conventional Sam Browne belt strap end portion 1B opposite its size adjustment end 1A. The remaining openings in platform 30 shown in FIG. 9 may be provided, if desired, to reduce the weight of the back plate.

Figure 10:
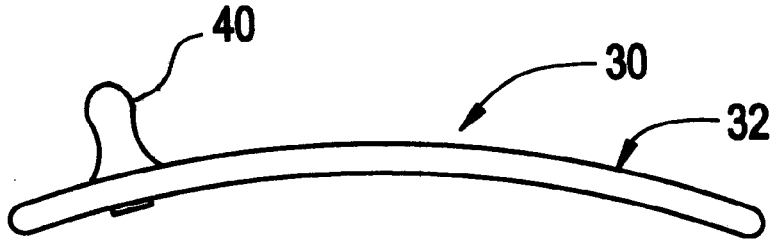
FIG. 10 is a side view of the fastening platform of FIG. 9.

FIG. 10 shows a side view of the back plate 32 with pre-assembled button 40 mounted within aperture 38. Back plate 32 may be gently curved as shown to accommodate the shape of the wearer's waist to achieve a more comfortable fit. By virtue of the button 40 being pre-assembled on the disclosed plate 32 of this invention, yet another precision assembly step in the conventional assembly process is eliminated while achieving yet further cost savings.

To consistently provide easy and reliable fitting of the belt to the wearer's waist regardless of size adjustment, the center of button aperture 38 is spaced apart from a center line 44 extending through apertures 34,36 a predetermined distance D corresponding to distance D' between a center line 44A extending through a pair of holes 3,5 and the center of a complementary button hole 4 in the size adjustment end portion 1A of strap 1 (FIG. 1). The spatial relationship between different pairs of size adjustment holes 3,5 and their respective complementary button hole 4 is maintained constant in belt end portion 1A, whereby fastening platform 30 serves to readily effect belt fitting regardless of different waist sizing requiring different positioning of buckle 20 on strap end portion 1A.

Figure 11:
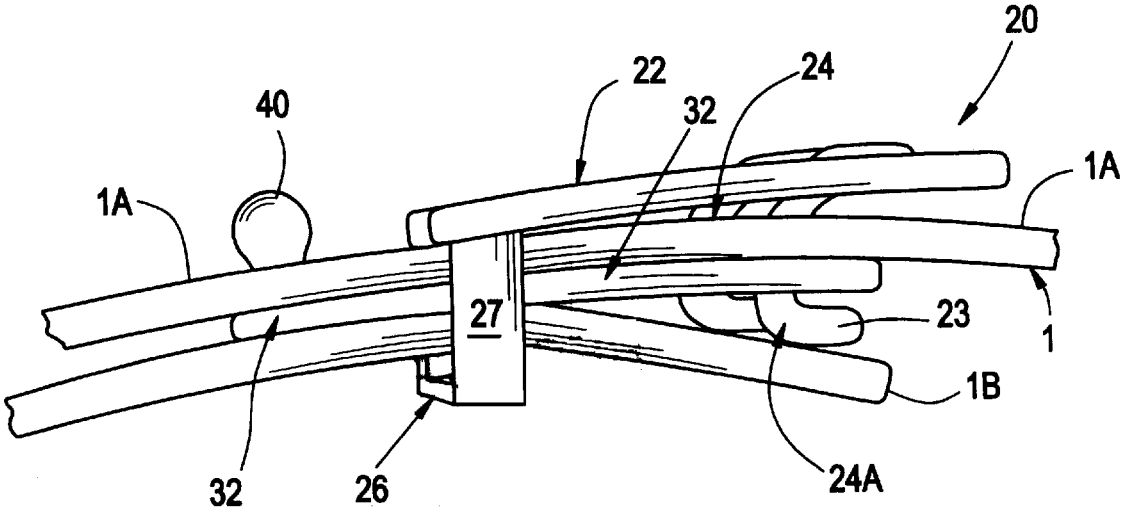
FIG. 11 is a perspective view, partly broken away, showing the end portion of the belt of FIG. 8 with its buckle engaging a fastening platform secured to an opposite end portion of the belt.

A preferred embodiment of an assembled device according to this invention is shown in FIG. 11 with buckle 20 having its tongues 24,24A extending through a conventional Sam Browne belt strap 1 as shown in FIG. 8 with a back plate 32 mounted such as by rivets, not shown, at the button end of its belt end portion 1B. The belt strap 1 is wrapped around the wearer's waist as the belt end portion 1B with its back plate 32 is guided through the retainer 26 toward tongues 24,24A of buckle 20. The top and bottom tongues 24,24A then anchor into top and bottom apertures 34,36 respectively, fastening belt end portion 1A onto the back plate 32. With the provision of button 40, precisely positioned as described above on back plate 32, button 40 registers with a hole 4 on the middle row of perforations to secure the otherwise loose strap end portion 1A.

As will now be appreciated, the buckle retainer 26 of the belt of this invention provides added resistance to accidental and forcible release even if the strap end 1A is pulled off button 40, for the retainer 26 captures both strap ends 1A and 1B and cooperates with buckle 20 in maintaining its tongues 24,24A in engagement with the back plate 32 with the end portions 1A, 1B of strap 1 maintained in underlying lapping relation to buckle frame 22.

Because the tongue receiving apertures 34,36 and button aperture 38 in the back plate 32 are readily established in a precisely predetermined position before the plate 32 is installed on the strap end portion 1B of a conventional Sam Browne belt strap, many manufacturing steps heretofore requiring precision and skill are entirely eliminated, thus reducing assembly and manufacturing costs and preventing errors which otherwise can result in further increased costs of manufacturing.

This invention is not limited to Sam Browne belts as its elements may be assembled in other embodiments to achieve fastening of straps for many and varied uses. Therefore, although this invention has been illustrated and described with respect to exemplary embodiments thereof, it should be understood by those skilled in the art that various changes, omissions and additions may be made without departing from the spirit and scope of the invention.

I claim:

1. A device comprising:

a strap having a size adjustment end portion and a first row and a second row of holes formed in the size adjustment end portion of the strap, the second row of holes being aligned with and corresponding to the first row of holes, and a buckle including a frame having a first tongue and a second tongue formed in fixed relation to the frame, each tongue having a first leg extending from one side of the frame toward a second side of the frame opposite its one side, a second terminal leg extending in a direction opposite said second side of the frame, and an intermediate portion interconnecting the legs, the buckle being removably mounted on the size adjustment end portion of the strap with the tongues of the frame projecting therefrom for passage through a selected pair of aligned holes in the size adjustment end portion of the strap for fastening the end portions of the strap in a loop of preselected size.

2. The device of claim 1 wherein a strap receiving retainer is formed on said second side of the frame in fixed underlying relation to the frame.

3. The device of claim 2 wherein the retainer includes a pair of spaced opposed arms and a bar interconnecting the arms integrally formed on a concealed back of said second side of the frame with the bar in spaced parallel relation thereto forming a generally rectangular strap receiving slot.

4. The device of claim 1 further including a plate attached to an end portion of the strap opposite its size adjustment end portion, the plate having a first aperture and a second aperture formed therein in aligned relation to the first aperture, the first and second apertures being registrar with the holes in the first and second rows of the size adjustment end portion of the strap, the tongues of the buckle frame projecting therefrom for passage through a selected pair of aligned holes in the size adjustment end portion of the strap and through the apertures formed in the plate for fastening the end portions of the strap in a loop of preselected size.

5. The device of claim 4 wherein the plate is in overlying relation to its attached strap end portion adjacent an end of the strap.

6. For use with a strap having a size adjustment end portion with a top row and a bottom row of equally spaced, vertically aligned holes, an adjustable buckle having a generally rectangular open frame defined by upper and lower bars and interconnecting sides for selective positioning on the size adjustment strap end portion, the buckle comprising a pair of spaced apart hook-shaped tongues integrally formed in fixed relation on one side of the frame, the tongues each having a first leg extending in a common direction from said one side of the frame toward a second side of the frame, a second terminal leg underlying the first leg and extending in a direction opposite said second side of the frame, and an intermediate portion interconnecting the legs.

7. The buckle of claim 6 wherein a retainer is integrally formed on a concealed face of the second side of the frame opposite said one side of the frame, the retainer forming a strap-receiving slot.

8. The buckle of claim 6 wherein the retainer includes a pair of spaced opposed arms and a bar interconnecting the arms integrally formed on a concealed back of said second side of the frame with the bar in spaced parallel relation thereto forming a generally rectangular strap receiving slot.

9. A device comprising:

a strap having a size adjustment end portion and a row of holes formed in the size adjustment end portion of the strap, a plate attached to an end portion of the strap opposite its size adjustment end portion, the plate having an aperture formed therein registrar with the holes in the size adjustment end portion of the strap, and a buckle including a frame having a tongue formed in fixed relation to the frame, the buckle being removably mounted on the size adjustment end portion of the strap with the tongue of the frame projecting therefrom for passage through a selected hole in the size adjustment end portion of the strap and through the aperture formed in the plate for fastening the end portions of the strap in a loop of preselected size, the buckle further including a retainer formed on the frame in fixed underlying relation to the frame for receiving and retaining the end portions of the strap in lapping underlying relation to the buckle.

10. A device comprising:

a strap having a size adjustment end portion, a first row of holes and a second row of holes formed in the size adjustment end portion of the strap, the second row of holes being aligned with and corresponding to the first row of holes, and a third row of holes formed in the size adjustment end portion of the strap about midway between the first and second rows of holes, the holes in the third row each being spaced apart a given predetermined distance from a center line projection extending through a selected aligned pair of holes respectively in the first row and second row of holes, a plate attached to an end portion of the strap opposite its size adjustment end portion, the plate having a first aperture and a second aperture formed therein in aligned relation to the first aperture, the first and second apertures being registrar respectively with the first row of holes and the second row of holes of the strap, and a buckle including a frame having a first tongue and a second tongue formed in fixed relation to the frame, the buckle being removably mounted on the size adjustment end portion of the strap with the first and second tongues of the frame projecting therefrom for passage through a selected hole in the first and second rows of holes respectively in the size adjustment end portion of the strap and through the first and second apertures formed in the plate for fastening the end portions of the strap in a loop of preselected size, the first and second tongues of the buckle cooperating with the plate for securing the end portions of the strap, the plate further including a button projecting from the plate about midway between the first and second apertures and spaced from a center line projection therebetween a distance equal to said given predetermined distance, whereby the button is positioned to penetrate the size adjustment strap end portion through a hole in the third row thereof with the tongues of the buckle projecting through the size adjustment strap end portion of the strap and the apertures of the plate to secure the strap end portions.

11. For use in engaging a pair of tongues of a buckle mounted on a size adjustment end portion of a conventional strap having three rows of holes including a top row and a bottom row of equally spaced, vertically aligned holes and a middle row of holes with each middle hole spaced a predetermined distance from a centerline projection of a complementary pair of aligned top and bottom holes in the size adjustment strap end portion, a fastening plate attachable to an end portion of the strap opposite its size adjustment end portion, the plate having first and second apertures in aligned spaced relation to one another corresponding to the spacing between the top and bottom rows of holes in the strap for receiving the tongues of the buckle extending through holes in the size adjustment strap end portion to the plate, the plate further including a third aperture positioned midway between the first and second apertures and spaced from a centerline projection thereof a distance equal to said predetermined distance, and a button mounted in the third aperture of the plate for registering with a given hole in the middle row to engage and secure the size adjustment end portion of the strap.

12. The plate of claim 11 wherein the plate is generally rectangular and is of arcuate configuration between its opposite longitudinal ends.

* * * * *